US011225095B2

(12) United States Patent
Kitahara

(10) Patent No.: US 11,225,095 B2
(45) Date of Patent: Jan. 18, 2022

(54) PRINTING APPARATUS

(71) Applicant: SEIKO EPSON CORPORATION, Tokyo (JP)

(72) Inventor: Masashi Kitahara, Minamiminowa-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/130,284

(22) Filed: Dec. 22, 2020

(65) Prior Publication Data

US 2021/0197597 A1 Jul. 1, 2021

(51) Int. Cl.

| | |
|---|---|
| ***B41J 15/16*** | (2006.01) |
| ***B41J 11/00*** | (2006.01) |
| ***B41J 15/04*** | (2006.01) |
| *B65H 5/02* | (2006.01) |

(52) U.S. Cl.

CPC ..... *B41J 15/16* (2013.01); *B41J 11/007* (2013.01); *B41J 15/048* (2013.01); *B65H 5/02* (2013.01)

(58) Field of Classification Search

CPC ..... B41J 15/16; B41J 11/007; B41J 3/4078; B41J 15/048; B65H 5/02

See application file for complete search history.

(56) References Cited

U.S. PATENT DOCUMENTS 8,672,323 B2 * 3/2014 Blanchard ..... B65H 29/56 271/276
2018/0272759 A1 * 9/2018 Shiiya ..... B41J 11/46

FOREIGN PATENT DOCUMENTS

JP H06-328113 A 11/1994

* cited by examiner

*Primary Examiner* — Henok D Legesse
(74) *Attorney, Agent, or Firm* — Workman Nydegger

(57) ABSTRACT

Included are a feeding shaft configured to hold a printing medium, a first transporting belt, a second transporting belt, a first driving roller on which the first transporting belt is wound, a second driving roller on which the second transporting belt is wound, a first driving unit configured to drive the first driving roller, a second driving unit configured to drive the second driving roller, a winding roller on which the printing medium is wound, a first winding roller bearing, a second winding roller bearing, a first load cell configured to detect a load exerted by the printing medium on the first winding roller bearing, a second load cell configured to detect a load exerted by the printing medium on the second winding roller bearing, and a control unit configured to control the first driving unit and the second driving unit based on detection results of the load cells.

7 Claims, 10 Drawing Sheets

PRINTING APPARATUS

The present application is based on, and claims priority from JP Application Serial Number 2019-234112, filed Dec. 25, 2019, the disclosure of which is hereby incorporated by reference herein in its entirety.

BACKGROUND

1. Technical Field

The present disclosure relates to a printing apparatus.

2. Related Art

Hitherto, there has been known a technique of suppressing meandering of a medium transported by a belt. For example, JP-A-6-328113 discloses a technique of suppressing meandering in a transporting device that transports a metal sheet with two belt conveyors aligned in a width direction. In the transporting device, a end of the sheet is detected by a detector arranged to each of the two belt conveyors, and deceleration is performed for a belt conveyor corresponding to a detector that detects the end first.

However, in JP-A-6-328113, when the medium to be transported is a deformable medium, meandering causes stretch and shrinkage, a shift, or the like. Thus, meandering is difficult to detect based on the edge of the sheet, and meandering cannot be suppressed in some cases.

SUMMARY

In order to solve the above-mentioned problem, a printing apparatus according to one aspect includes a feeding shaft configured to hold a printing medium wound in a roll shape, a first transporting belt configured to transport, in a transport direction, the printing medium fed from the feeding shaft, a second transporting belt configured to transport, in the transport direction, the printing medium fed from the feeding shaft, the second transporting belt being arranged side by side with the first transporting belt in an intersecting direction intersecting the transport direction, a first driving roller and a first driven roller on which the first transporting belt is wound, a second driving roller and a second driven roller on which the second transporting belt is wound, a first driving unit configured to drive the first driving roller, a second driving unit configured to drive the second driving roller, a winding roller on which the printing medium is wound that is transported from the feeding shaft to the first transporting belt and the second transporting belt, a first bearing configured to support one end of a shaft of the winding roller, a second bearing configured to support another end of the shaft of the winding roller, a first detector configured to detect a load exerted by the printing medium on the first bearing through the winding roller, a second detector configured to detect a load exerted by the printing medium on the second bearing through the winding roller, and a control unit configured to control the first driving unit and the second driving unit based on detection results of the first detector and the second detector.

DESCRIPTION OF EXEMPLARY EMBODIMENTS

Exemplary embodiments to which the present disclosure is applied are described below with reference to the drawings. Note that, in each drawing, for convenience of understanding, each member is illustrated in a scale different from reality.

In FIG. 1 to FIG. 5 and FIG. 9 to FIG. 10, for convenience of description, an X-axis, a Y-axis, and a Z-axis are illustrated as three axes orthogonal to one another. In an installation state of a printing apparatus 1, the Z-axis corresponds to a vertical direction, and the X-axis and the Y-axis are directions along a horizontal plane. Each of the arrows indicating the axis directions has a distal end side corresponding to a "+ side" and a base end side corresponding to a "− side".

First Exemplary Embodiment

First, a first exemplary embodiment is described.

Figure 1:
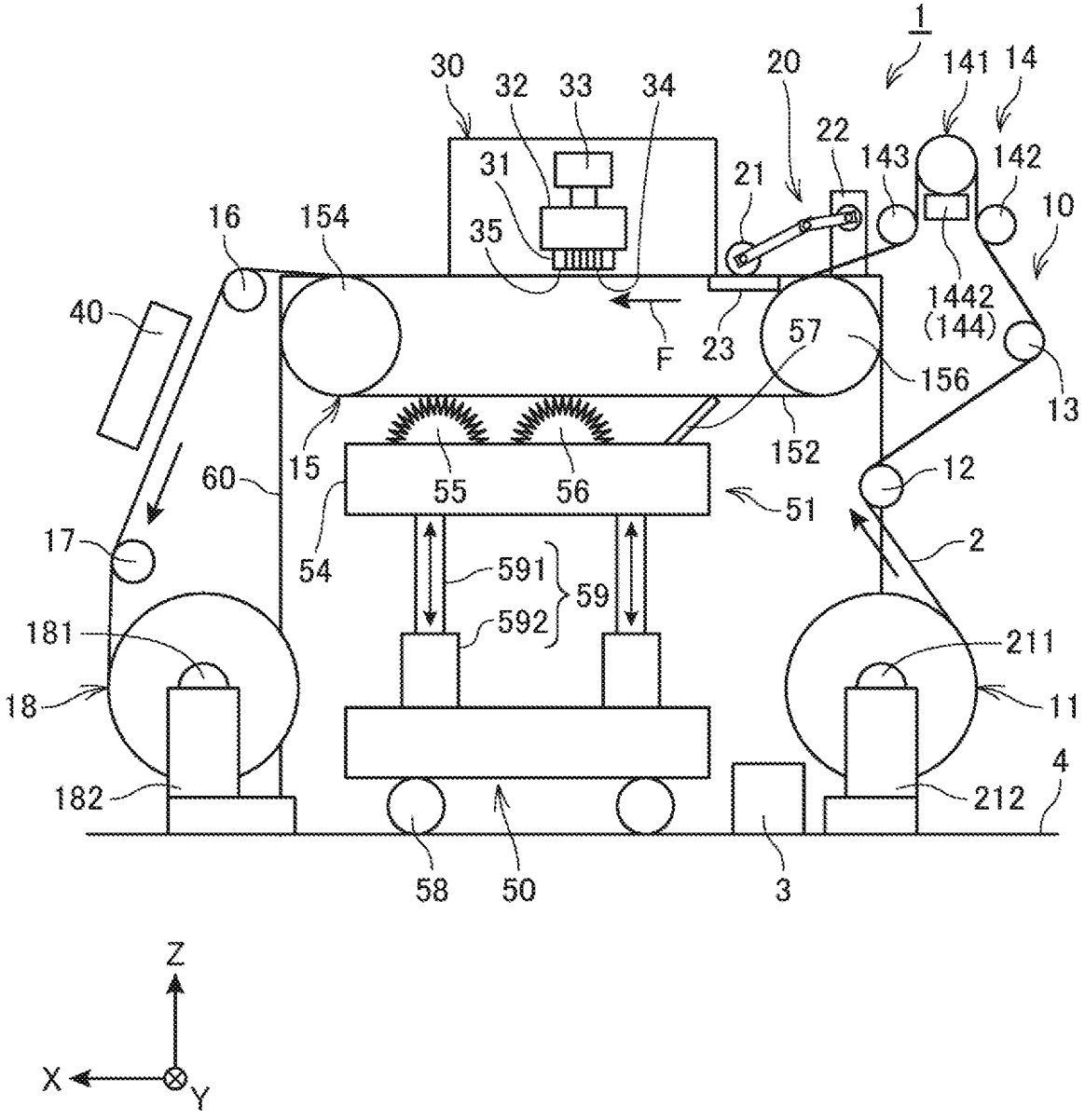
FIG. 1 is a schematic configuration view of a printing apparatus.

FIG. 1 is a schematic configuration view of the printing apparatus 1.

The printing apparatus 1 is an ink jet-type printing apparatus that forms an image by ejecting ink onto a printing medium 2.

As the printing medium 2 used in the printing apparatus 1, sheets formed of various materials such as paper and a synthetic resin may be used. For example, a paper sheet dedicated for ink jet recording such as plain paper, woodfree paper, and coated paper may be used. In the following description, a configuration in which, as the printing medium 2, a fiber cloth formed of natural fibers such as cotton and wool, synthetic fibers such as polyester, or fibers obtained by mixing those is given. The printing apparatus 1 functions as a textile printer that performs textile printing on the printing medium 2 by causing ink to adhere to a printing surface of the printing medium 2.

The printing apparatus 1 includes a medium transporting unit 10, a medium fitting unit 20, a printing unit 30, a drying unit 40, a cleaning unit 50, and the like, and each of those units is mounted to a frame portion 60. Further, the printing apparatus 1 includes a control device 3 that controls the units described above.

The medium transporting unit 10 includes a medium feeding portion 11, the transporting rollers 12 and 13, a meandering detection unit 14, a transporting belt unit 15, transporting rollers 16 and 17, and a medium winding portion 18, and transports the printing medium 2 in a transport direction. The transport direction in which the medium transporting unit 10 transports the printing medium 2 is a direction indicated with the arrow F in the drawings, and corresponds to the +X-axis direction.

The medium feeding portion 11 feeds the printing medium 2 toward the printing unit 30. The medium feeding portion 11 includes a tubular or columnar feeding shaft 211 and a bearing 212 that rotatably supports the feeding shaft 211. The medium feeding portion 11 includes a rotary driving portion (not shown) that drives the feeding shaft 211 in accordance with control of the control device 3. A roll body obtained by winding the band-like printing medium 2 in a roll shape is mounted to the feeding shaft 211. When the feeding shaft 211 rotates, the printing medium 2 is fed in the transport direction. The feeding shaft 211 is removable mounted to the bearing 212.

The transporting rollers 12 and 13 relay the printing medium 2 fed from the feeding shaft 211 to the meandering detection unit 14.

The meandering detection unit 14 includes a winding roller portion 141, a first auxiliary roller 142, a second auxiliary roller 143, and two load cells 144. In the present exemplary embodiment, those components are arranged on an upper side with respect to the transporting belt unit 15. The upper side corresponds to the +Z-axis direction.

The first auxiliary roller 142 is an auxiliary roller that supports winding of the printing medium 2 about a winding roller 1411 of the winding roller portion 141, and is arranged downstream of the transporting roller 13 and upstream of the winding roller 1411 in the transport direction. Further, the first auxiliary roller 142 is arranged on a lower side with respect to the winding roller 1411. The first auxiliary roller 142 supports winding of the printing medium 2 under a state of being held in contact with the printing surface of the printing medium 2. The lower side corresponds to the −Z-axis direction.

The second auxiliary roller 143 is an auxiliary roller that supports winding of the printing medium 2 about the winding roller 1411 of the winding roller portion 141, and is arranged downstream of the winding roller 1411 and upstream of a press roller 21 described later in the transport direction. Further, the second auxiliary roller 143 is arranged on a lower side with respect to the winding roller 1411. The second auxiliary roller 143 supports winding of the printing medium 2 under a state of being held in contact with the printing surface of the printing medium 2. The lower side corresponds to the −Z-axis direction.

Figure 2:
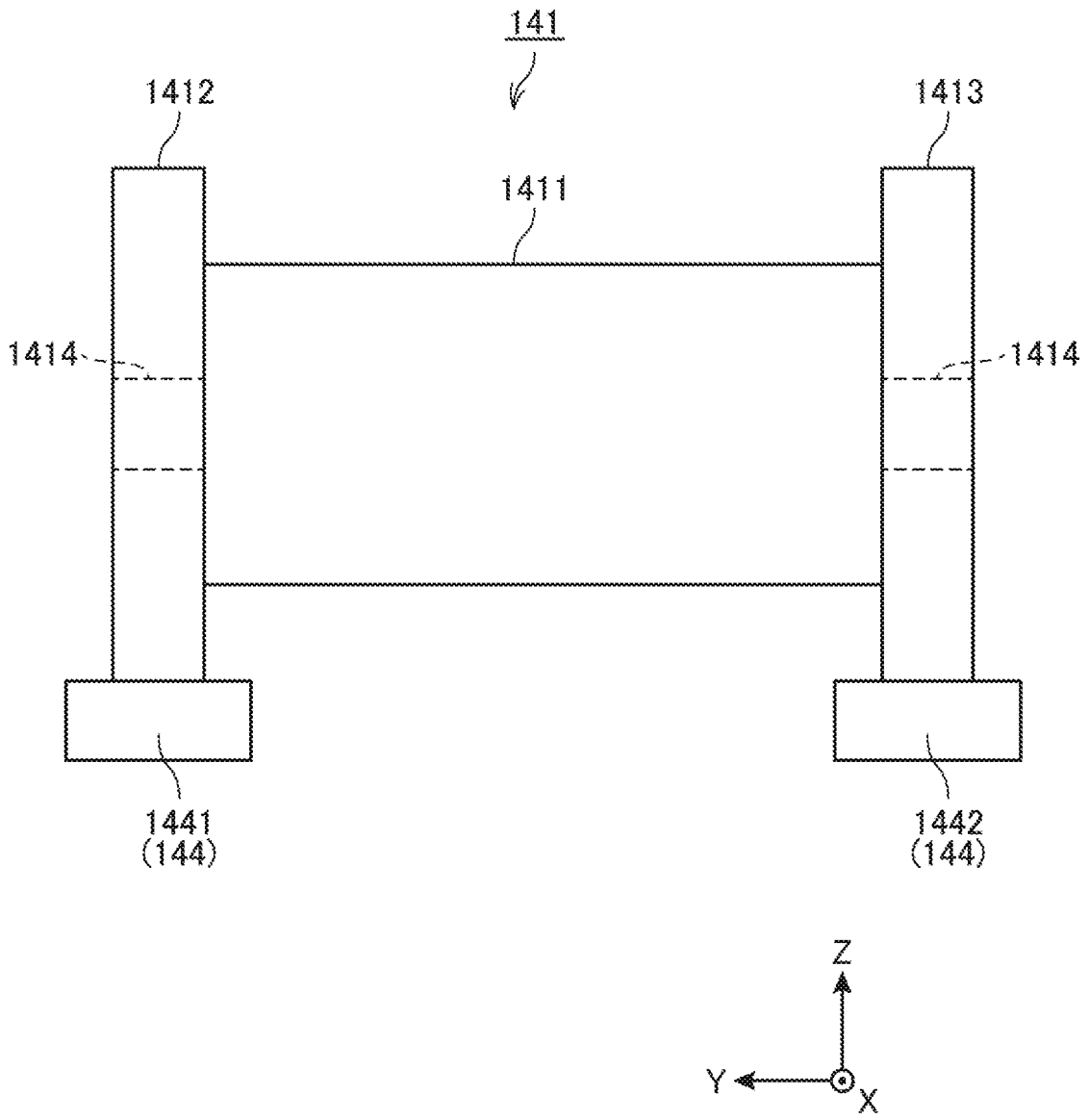
FIG. 2 is a view illustrating a configuration of a winding roller portion.

FIG. 2 is a view illustrating a configuration of the winding roller portion 141.

As illustrated in FIG. 2, the winding roller portion 141 includes the winding roller 1411, a first winding roller bearing 1412, and the second winding roller bearing 1413. The first winding roller bearing 1412 corresponds to an example of a first bearing, and the second winding roller bearing 1413 corresponds to an example of a second bearing.

The winding roller 1411 is a tubular or columnar roller on which the printing medium 2 fed by the medium feeding portion 11 is wound. The winding roller 1411 rotates about a rotary shaft 1414 along with transporting of the printing medium 2.

The first winding roller bearing 1412 and the second winding roller bearing 1413 rotatably support the winding roller 1411. The first winding roller bearing 1412 supports an end on a left side among the ends of the rotary shaft 1414 of the winding roller 1411. The left side corresponds to the +Y-axis direction. Further, the second winding roller bearing 1413 supports an end on a right side among the ends of the rotary shaft 1414 of the winding roller 1411. The right side corresponds to the −Y-axis direction.

On the lower side of the first winding roller bearing 1412, a first load cell 1441 is arranged to abut on the first winding roller bearing 1412. The first load cell 1441 corresponds to an example of a first detector. The first load cell 1441 measures a force with which the printing medium 2 presses the winding roller 1411 downward as a load L1 applied to the first winding roller bearing 1412, and outputs a first measured signal SG1 indicating the measured load L1 to the control device 3.

On the lower side of the second winding roller bearing 1413, a second load cell 1442 is arranged to abut on the second winding roller bearing 1413. The second load cell 1442 corresponds to an example of a second detector. The second load cell 1442 measures a force with which the printing medium 2 presses the winding roller 1411 downward as a load L2 applied to the second winding roller bearing 1413, and outputs a second measured signal SG2 indicating the measured load L2 to the control device 3.

When the load L1 applied to the first winding roller bearing 1412 and the load L2 applied to the second winding roller bearing 1413 are not distinguished from each other, the expression "loads L" is given.

A tensile force acting on the printing medium 2 wound about the printing medium 2 wound about the winding roller 1411 changes, the force pressing the printing medium 2 downward changes in the winding roller 1411. Thus, the first load cell 1441 and the second load cell 1442 are capable of measuring the tensile force acting on the printing medium 2 as the load L applied from the printing medium 2 to the first winding roller bearing 1412 and the second winding roller bearing 1413. When the printing medium 2 meanders, transported amounts are different from each other at both the edges of the printing medium 2 in an intersecting direction that intersects the transport direction. Thus, the acting tensile forces are different from each other. Thus, the meandering detection unit 14 is capable of detecting meandering based on the difference between the load L measured by the first load cell 1441 and the load L measured by the second load cell 1442. Note that the intersecting direction corresponds to the Y-axis direction.

Referring back to the description of FIG. 1, the transporting belt unit 15 transports the printing medium 2 in the transport direction with a first transporting belt 151 and a second transporting belt 152.

Figure 3:
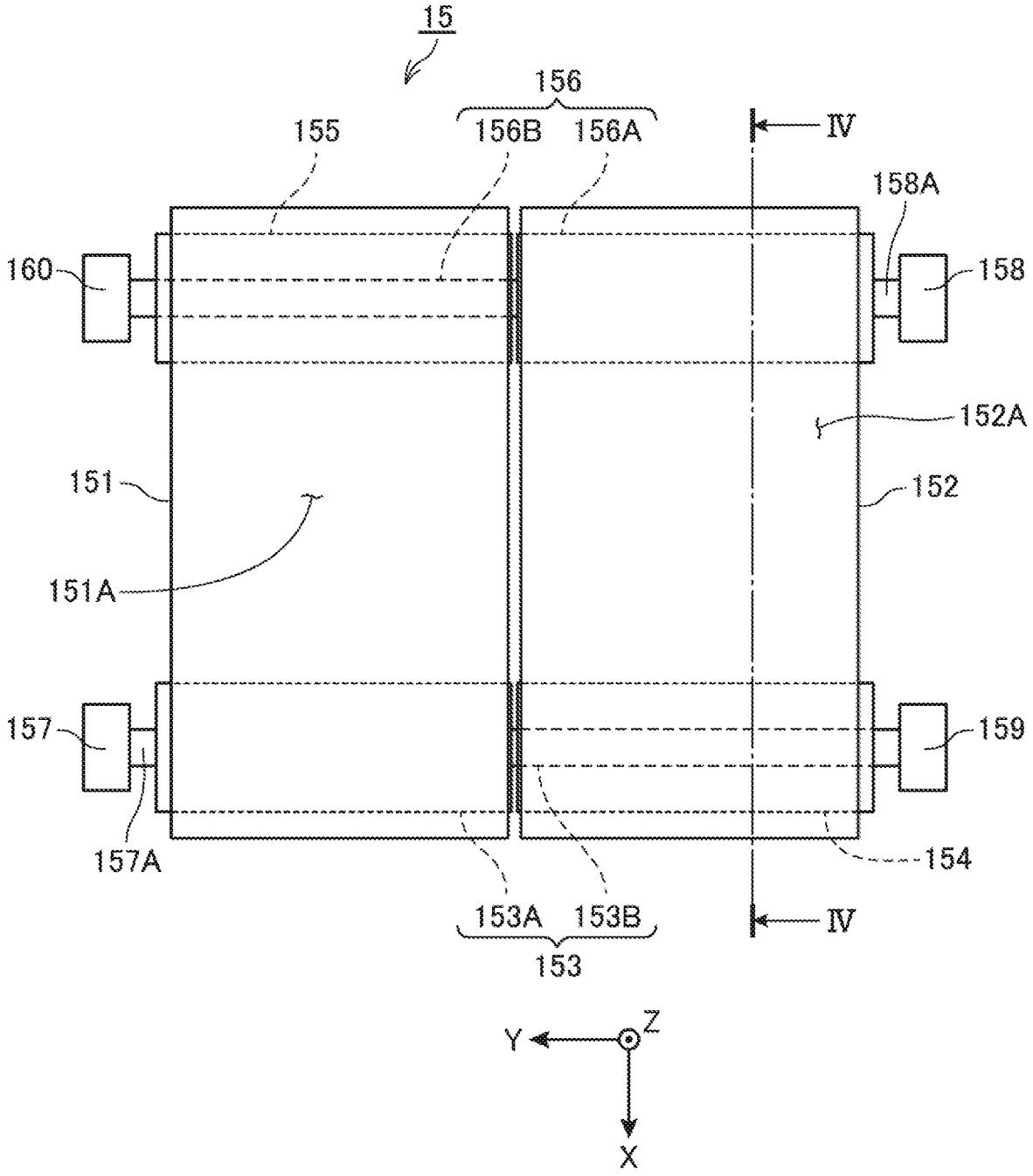
FIG. 3 is a plan view of a transporting belt unit seen from above.

FIG. 3 is a plan view of the transporting belt unit 15 seen from above.

The transporting belt unit 15 includes the first transporting belt 151, the second transporting belt 152, a first driving roller 153, a second driving roller 156, a first driven roller 155, and a second driven roller 154.

The first transporting belt 151 has an endless shape in which both ends of a band-like belt are joined to each other, and is wound about a large diameter portion 153A of the first driving roller 153 and the first driven roller 155. The first transporting belt 151 is held under a state in which a predetermined tensile force acts thereon in such a way that a part between the large diameter portion 153A of the first driving roller 153 and the first driven roller 155 is parallel to a floor 4. On a surface 151A of the first transporting belt 151, an adhesive layer adhering to the printing medium 2 is provided.

Similarly to the first transporting belt 151, the second transporting belt 152 has an endless shape, is wound about a large diameter portion 156A of the second driving roller 156 and the second driven roller 154. The second transporting belt 152 is held under a state in which a predetermined tensile force acts thereon in such a way that a part between the large diameter portion 156A of the second driving roller 156 and the second driven roller 154 is parallel to the floor 4. On a surface 152A of the second transporting belt 152, an adhesive layer adhering to the printing medium 2 is provided.

The printing medium 2 is transported to the first transporting belt 151 and the second transporting belt 152 of the transporting belt unit 15 via the meandering detection unit 14, is brought into close contact with the surfaces 151A and 152A with an adhesive force of the adhesive layers, and is supported or held by the first transporting belt 151 and the second transporting belt 152. With this, a stretchable fiber cloth and the like may be handled as the printing medium 2.

The large diameter portion 153A of the first driving roller 153 and the first driven roller 155 are held in contact with an inner circumferential surface of the first transporting belt 151, and drive the first transporting belt 151 due to friction with the inner circumferential surface.

The first driving roller 153 is coupled to a first driving motor 157 that rotatably drives the first driving roller 153, and rotates with a driving force of the first driving motor 157. The first driven roller 155 is a driven roller, and is arranged side by side with the first driving roller 153 in the transport direction. The first driven roller 155 rotates along with rotation of the first transporting belt 151 due to rotation of the first driving roller 153.

Figure 4:
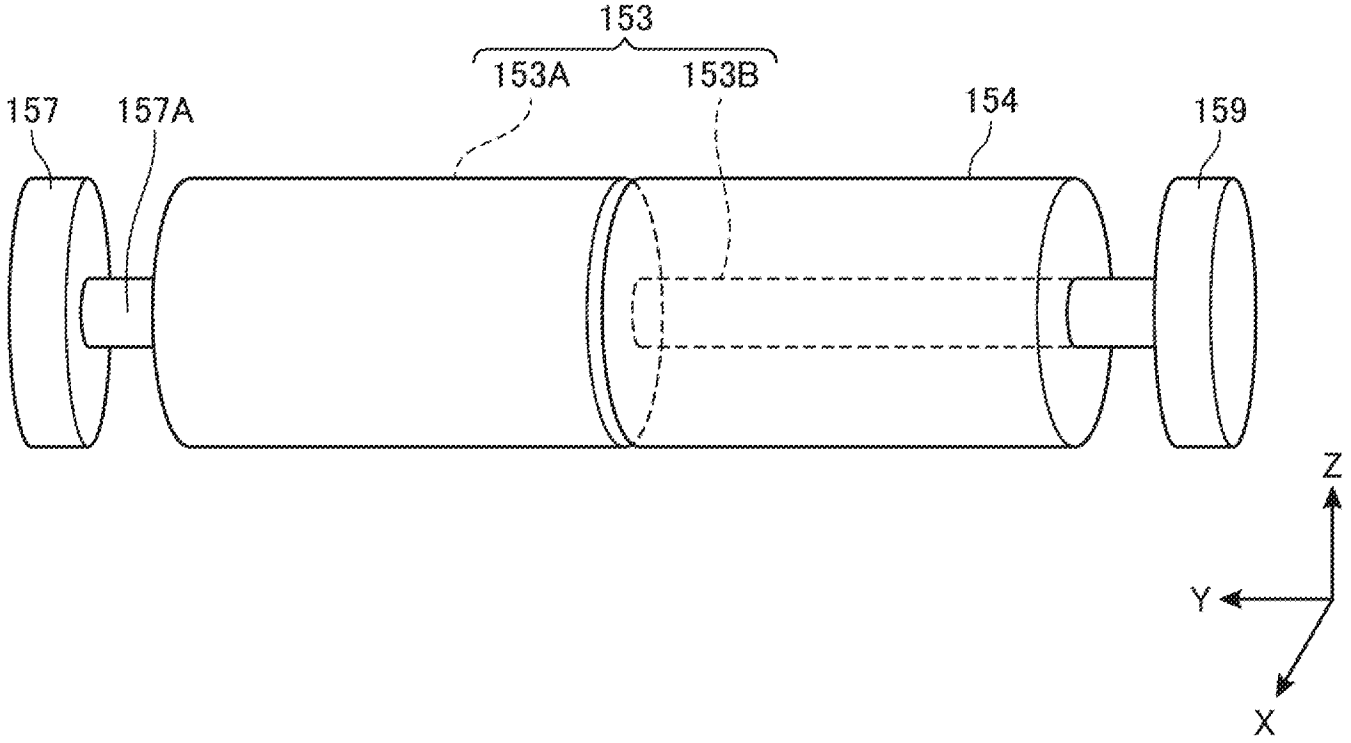
FIG. 4 is a perspective view of a first driving roller and a second driven roller.

The tubular second driven roller 154 is assembled to the first driving roller 153. FIG. 4 is a perspective view of the first driving roller 153 and the second driven roller 154.

The first driving roller 153 includes the large diameter portion 153A and a small diameter portion 153B having a diameter smaller than that of the large diameter portion 153A. The large diameter portion 153A and the small diameter portion 153B are columnar rollers. The large diameter portion 153A and the small diameter portion 153B are arrayed concentrically in the axis direction. A left end of the large diameter portion 153A in the axis direction is coupled to the first driving motor 157 through a driving shaft 157A. A right end of the small diameter portion in the axis direction is rotatably supported by a bearing 159.

Figure 5:
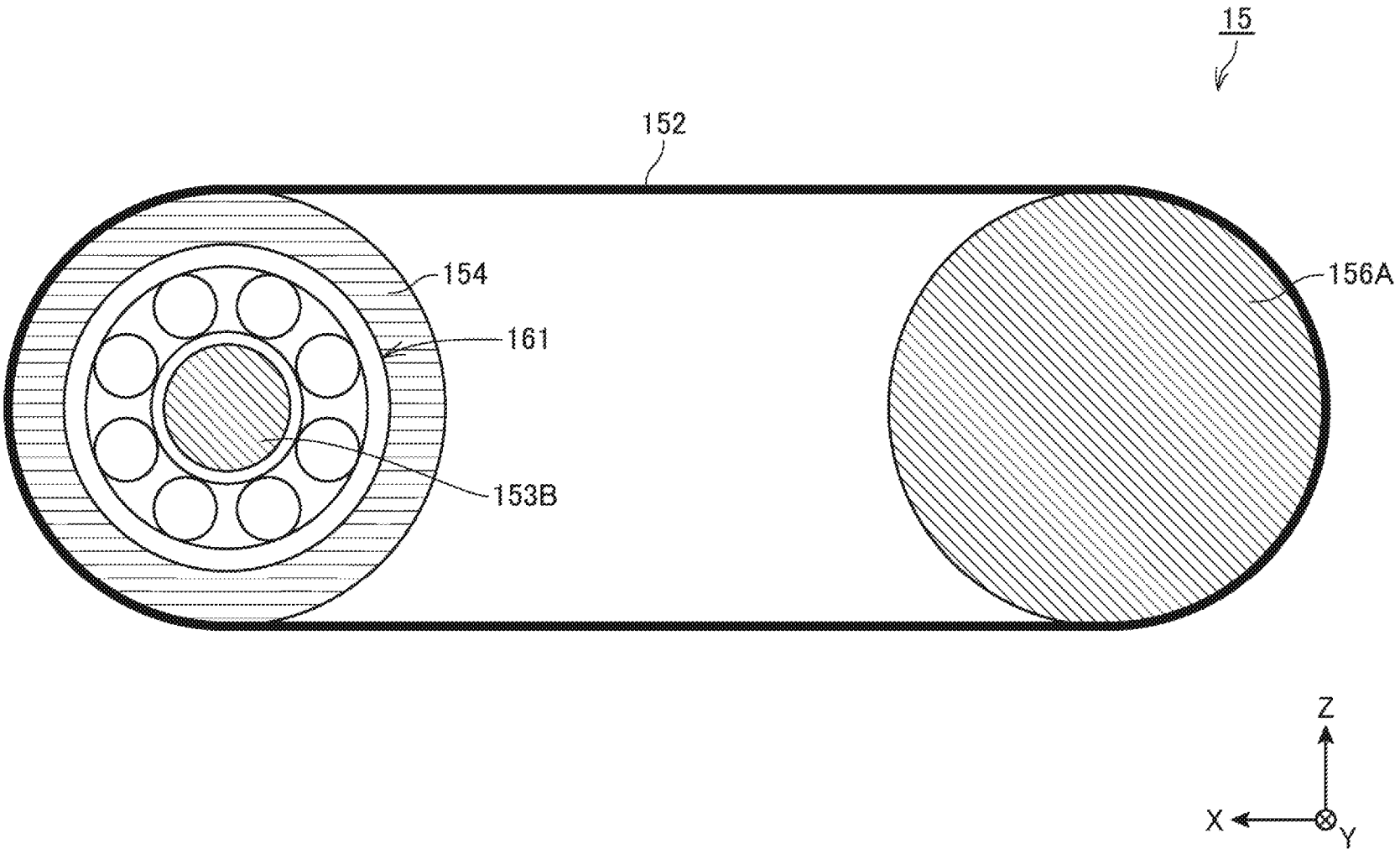
FIG. 5 is a cross-sectional view taken along the line IV-IV in FIG. 3.

FIG. 5 is a cross-sectional view taken along the line IV-IV in FIG. 3.

As illustrated in FIG. 5, the small diameter portion 153B is assembled to the second driven roller 154 through a bearing mechanism 161, and supports the second driven roller 154 in a freely rotatable manner. In FIG. 5, a ball bearing is given as an example of the bearing mechanism 161. However, the bearing mechanism 161 is not limited to the ball bearing, and may be a roller bearing and a sleeve bearing. The second driven roller 154 has an outer diameter that is substantially equal to the large diameter portion 153A. The second driven roller 154 is assembled to the small diameter portion 153B through the bearing mechanism 161, and hence rotates along with rotation of the second driving roller 156 with the small diameter portion 153B as the rotation center while being prevented from rotating along with the first driving roller 153.

The large diameter portion 156A of the second driving roller 156 and the second driven roller 154 are held in contact with the inner circumferential surface of the first transporting belt 151, and drive the second transporting belt 152 due to friction with the inner circumferential surface.

The second driving roller 156 is coupled to a second driving motor 158 that rotatably drives the second driving roller 156, and rotates with a driving force of the second driving motor 158. The second driven roller 154 is arranged side by side with the second driving roller 156 in the transport direction. The second driven roller 154 rotates along with rotation of the second transporting belt 152 due to rotation of the second driving roller 156.

The tubular first driven roller 155 is assembled to the second driving roller 156.

Similarly to the first driving roller 153, the second driving roller 156 includes the large diameter portion 156A and a small diameter portion 156B having a diameter smaller than that of the large diameter portion 156A. The large diameter portion 156A and the smaller diameter portion 156B are columnar rollers. The large diameter portion 156A and the smaller diameter portion 156B are arrayed concentrically in the axis direction. A right end of the large diameter portion 156A in the axis direction is coupled to the second driving motor 158 through a driving shaft 158A. A left end of the smaller diameter portion 156B in the axis direction is rotatably supported by a bearing 160.

Similarly to the small diameter portion 153B, the smaller diameter portion 156B is assembled to the first driven roller 155 through the bearing mechanism 161, and supports the first driven roller 155 in a freely rotatable manner. The first driven roller 155 has an outer diameter that is substantially equal to the large diameter portion 156A. The first driven roller 155 is assembled to the smaller diameter portion 156B through the bearing mechanism 161, and hence rotates along with rotation of the first driving roller 153 with the smaller diameter portion 156B as the rotation center while being prevented from rotation along with the second driving roller 156.

As described above, the first driving roller 153 supports the second driven roller 154 in a freely rotatable manner, and the second driving roller 156 supports the first driven roller 155 in a freely rotatable manner. Thus, a member that supports the ends of the first driven roller 155 and the second driven roller 154 in the axis direction in a freely rotatable manner is not required to be arranged between the first transporting belt 151 and the second transporting belt 152 in the intersecting direction. Thus, the distance by which the first transporting belt 151 and the second transporting belt 152 are separated from each other can be reduced to be as small as possible, and the first transporting belt 151 and the second transporting belt 152 can be arranged side by side in the intersecting direction.

Referring back to the description of FIG. 1, the printing unit 30 is positioned on the upper side of the transporting belt unit 15, and the cleaning unit 50 is arranged on the lower side of the transporting belt unit 15. Note that, at the positions facing the printing unit 30, the first transporting belt 151 and the second transporting belt 152 move in the transport direction together with the printing medium 2. At the positions facing the cleaning unit 50, the first transporting belt 151 and the second transporting belt 152 move in a direction opposite to the transport direction.

The printing unit 30 forms an image on the printing medium 2. The transporting roller 16 is positioned downstream of the printing unit 30 and the transporting belt unit 15 in the transport direction, and peels the printing medium 2 off from the adhesive layers of the first transporting belt 151 and the second transporting belt 152. The printing medium 2 is transported to the medium winding portion 18 via the transporting roller 16 and the transporting roller 17.

The medium winding portion 18 winds up the printing medium 2. The medium winding portion 18 includes a tubular or columnar winding shaft 181 and a bearing 182 rotatably supports the winding shaft 181. The medium winding portion 18 includes a rotary driving portion (not shown) that rotatably drives the winding shaft 181. When the winding shaft 181 rotates, the printing medium 2 is wound about the winding shaft 181. The winding shaft 181 is removably mounted to the bearing 182.

The medium fitting unit 20 is positioned upstream of the printing unit 30 in the transport direction, and brings the printing medium 2 into close contact with the first transporting belt 151 and the second transporting belt 152. The medium fitting unit 20 includes the press roller 21, a press roller driving portion 22, and a roller support portion 23. The press roller 21 is formed in a tubular or columnar shape, and is provided rotatably in a circumferential direction. The roller support portion 23 is arranged on the inner circumferential surface sides of the first transporting belt 151 and the second transporting belt 152 in such a way to face the press roller 21 across the first transporting belt 151 and the second transporting belt 152. Note that the roller support portion 23 may be provided for each of the first transporting belt 151 and the second transporting belt 152.

The press roller driving portion 22 causes the press roller 21 to move in the transport direction and the direction opposite to the transport direction while pressing the press roller 21 downward. With a pressing force of the press roller driving portion 22, the printing medium 2 is pressed against the first transporting belt 151 and the second transporting belt 152 between the press roller 21 and the roller support portion 23.

The printing unit 30 includes an ejection head 31 that ejects ink onto the printing medium 2, the carriage 32 on which the ejection head 31 is mounted, and a carriage moving unit 33 that causes the carriage 32 to move in the intersecting direction. The ejection head 31 includes a nozzle plate 35 on which a plurality of nozzle rows 34 are formed. For example, four nozzle rows 34 are formed on the nozzle plate 35, and ink of different colors corresponding to the respective nozzle rows 34 is ejected. With this, color printing is performed on the printing medium 2.

The carriage 32 is supported by a guide rail (not shown) arranged along the Y-axis direction being the intersecting direction, and is caused to reciprocate in the Y-axis direction by the carriage moving unit 33.

The drying unit 40 is provided between the transporting roller 16 and the transporting roller 17. The drying unit 40 includes a heating mechanism such as an IR heater, and dries ink on the printing medium 2 by heating the printing medium 2.

The cleaning unit 50 includes a cleaning section 51, a pressing section 52, and a moving section 53. The cleaning section 51 includes a cleaning tank 54 that stores cleaning liquid, a first cleaning brush 55 and a second cleaning brush 56 that abut on the first transporting belt 151 and the second transporting belt 152 rotate, and a blade 57. The first cleaning brush 55 and the second cleaning brush 56 are brushes that abut on the surface 151A of the first transporting belt 151 and the surface 152A of the second transporting belt 152, rotate with a driving force of a brush driving motor 90 illustrated in FIG. 7, and cleans the surfaces 151A and 152A with the cleaning liquid. For example, the blade 57 is formed of a flexible material such as silicon rubber, and is arranged downstream of the second cleaning brush 56 in the rotation direction of the first transporting belt 151 and the second transporting belt 152. The blade 57 scrapes the cleaning liquid off from the surfaces 151A and 152A, and obtains a state under which the printing medium 2 can be brought into close with the surfaces 151A and 152A. The moving section 58 supports the cleaning unit 50 in such a way to move with respect to the floor 4. The press section 59 is a lifting device including, for example, an air cylinder 591 and a ball bush 592, and is capable adjusting and holding the height of the cleaning section 51.

Figure 6:
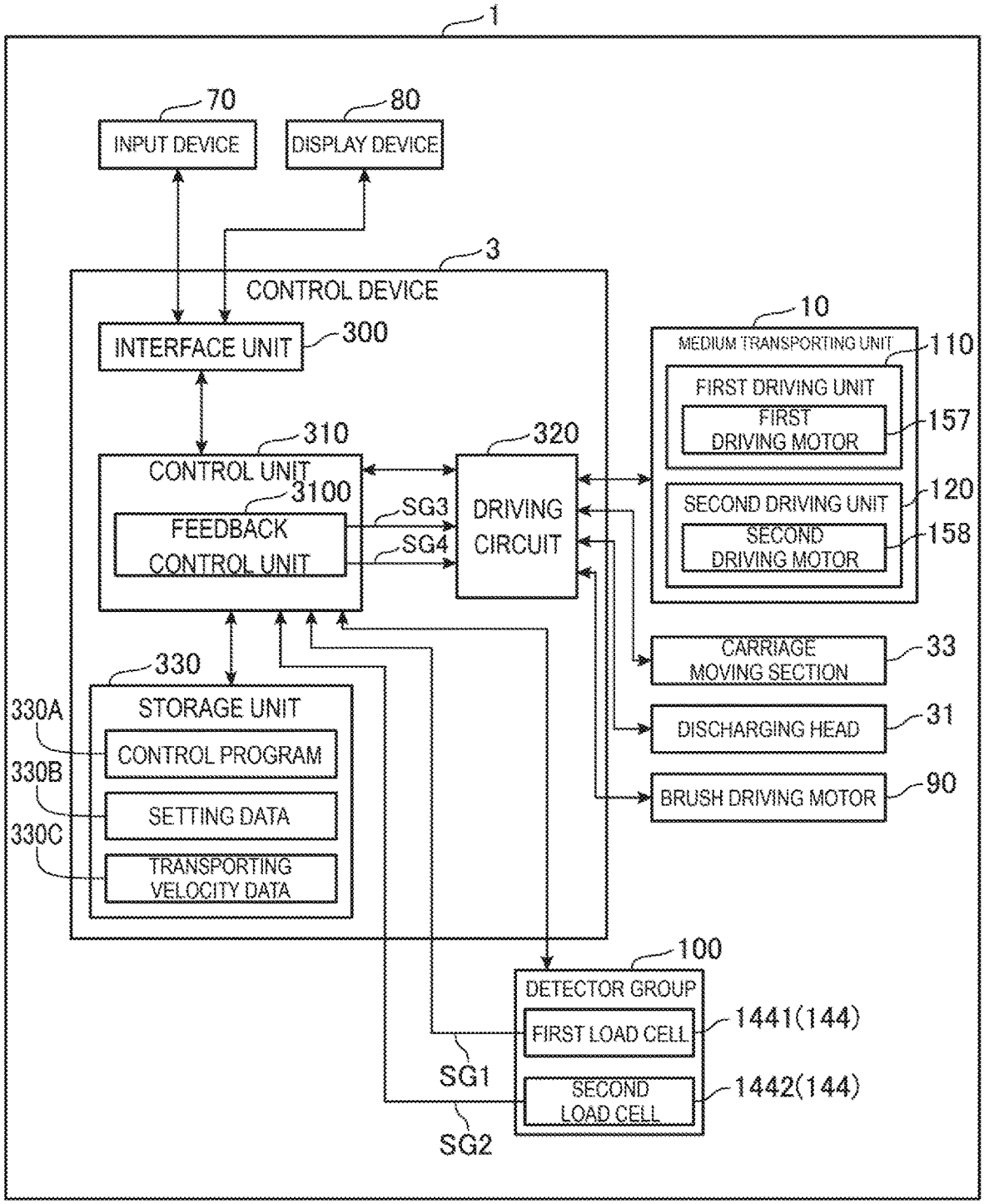
FIG. 6 is a block diagram illustrating a control system of the printing apparatus.

FIG. 6 is a block diagram illustrating a control system of the printing apparatus 1.

The printing apparatus 1 includes an input device 70 and a display device 80, and those devices are connected to the control device 3. The input device 70 is a device through which an operator operating the printing apparatus 1 inputs printing conditions and the like, and is an input device such as a keyboard and a mouse. The input device 70 may be a desktop-type or laptop-type personal computer, a tablet-type terminal, a portable-type terminal, or the like, and may be provided independently from the printing apparatus 1. The input device 70 outputs information input by the operator to the control device 3. The display device 80 includes a display screen such as a liquid crystal display panel, and displays various types of information in accordance with control of the control device 3.

The control device 3 includes an interface unit 300, a control unit 310, a driving circuit 320, and a storage unit 330. The control unit 310 includes a processor such as a Central Processing Unit (CPU), and controls each part of the printing apparatus 1 in collaboration with software and hardware by executing a program by the processor. The control unit 310 reads out and executes a control program 330A stored in the storage unit 330, and thus functions as a feedback control unit 3100.

The interface unit 300 is connected to the input device 70 and the display device 80, and transmits and receives data between those devices.

The driving circuit 320 is connected to the medium transporting unit 10, the carriage moving unit 33, the ejection head 31, and the brush driving motor 90.

The storage unit 330 includes a semiconductor storage device or a magnetic recording device, and stores the control program 330A executed by the processor of the control unit 310, setting data 330B relating to settings of the printing apparatus 1, and other data processed by the control unit 310. Further, the storage unit 330 stores transporting velocity data 330C. The transporting velocity data 330C is data indicating velocity of the printing medium 2 transported by the first transporting belt 151 and the second transporting belt 152, and indicates transporting velocity that is set by a user or the like in advance. The transporting velocity indicated in the transporting velocity data 330C can be changed as appropriate. The transporting velocity indicated in the transporting velocity data 330C corresponds to predetermined velocity.

The control device 3 controls the driving circuit 320, and causes the driving circuit 320 to output a control signal. With this, the medium transporting unit 10, the carriage moving unit 33, the ejection head 31, and the brush driving motor 90 are operated.

The control device 3 drives each motor included in the medium transporting unit 10, and causes the printing medium 2 to move in the transport direction. The control device 3 drives the first driving motor 157 of a first driving unit 110 included in the medium transporting unit 10 and the second driving motor 158 of a second driving unit 120 included in the medium transporting unit 10, and causes the printing medium 2 to move in the transport direction. In addition to the first driving motor 157, the first driving unit 110 includes a driving force transmission mechanism such as the driving shaft 157A of the first driving motor 157. In addition to the second driving motor 158, the second driving unit 120 includes a driving force transmission mechanism such as the driving shaft 158A of the second driving motor 158.

The control device 3 drives a motor included in the carriage moving unit 33, and causes the carriage 32 to move in the Y-axis direction. The control device 3 drives the ejection head 31, and causes the ejection head 31 to eject ink onto the printing medium 2. The control device 3 repeats main scanning and sub scanning. In the main scanning, the control device 3 controls the carriage moving unit 33 and the ejection head 31, and thus the carriage 32 is caused to move while the ejection head 31 ejects ink. In the sub scanning, the control device 3 controls the medium transporting unit 10, and thus the printing medium 2 is transported in the transport direction. With this control, an image is formed on the printing medium 2.

The control device 3 drives the brush driving motor 90, and causes the first cleaning brush 55 and the second cleaning brush 56 to rotate. Note that a configuration in which each part (not shown) the printing apparatus 1 is connected to the control device 3 and is controlled by the control device 3 may be adopted.

The detector group 100 including various other sensors is connected to the control device 3. The control device 3 acquires a detection signal from the detector group 100, and reflects the signal to control with the driving circuit 320. In the present exemplary embodiment, the control device 3 acquires the first measured signal SG1 from the first load cell 1441 included in the detector group 100, and further acquires the second measured signal SG2 from the second load cell 1442 included in the detector group 100. Further, the control device 3 reflects the first measured signal SG1 and the second measured signal SG2 that are acquired to driving of the first driving motor 157 and the second driving motor 158 with the driving circuit 320.

As described above, the control unit 310 functions as the feedback control unit 3100. The feedback control unit 3100 subjects the first driving motor 157 and the second driving motor 158 to feedback control. Further, the feedback control unit 3100 outputs a first instruction signal SG3 and a second instruction signal SG4 to the driving circuit 320. the first instruction signal SG3 indicates rotational velocity of the first driving motor 157, which is acquired through feedback control, and the second instruction signal SG4 indicates rotational velocity of the second driving motor 158, which is acquired through feedback control. When the first instruction signal SG3 is input, the driving circuit 320 outputs a control signal to the first driving motor 157. With this, the first driving motor 157 rotates at rotational velocity indicated with the first instruction signal. Further, when the second instruction signal SG4 is input, the driving circuit 320 outputs a control signal to the second driving motor 158. With this, the second driving motor 158 rotates at rotational velocity indicated with the second instruction signal SG4.

Figure 7:
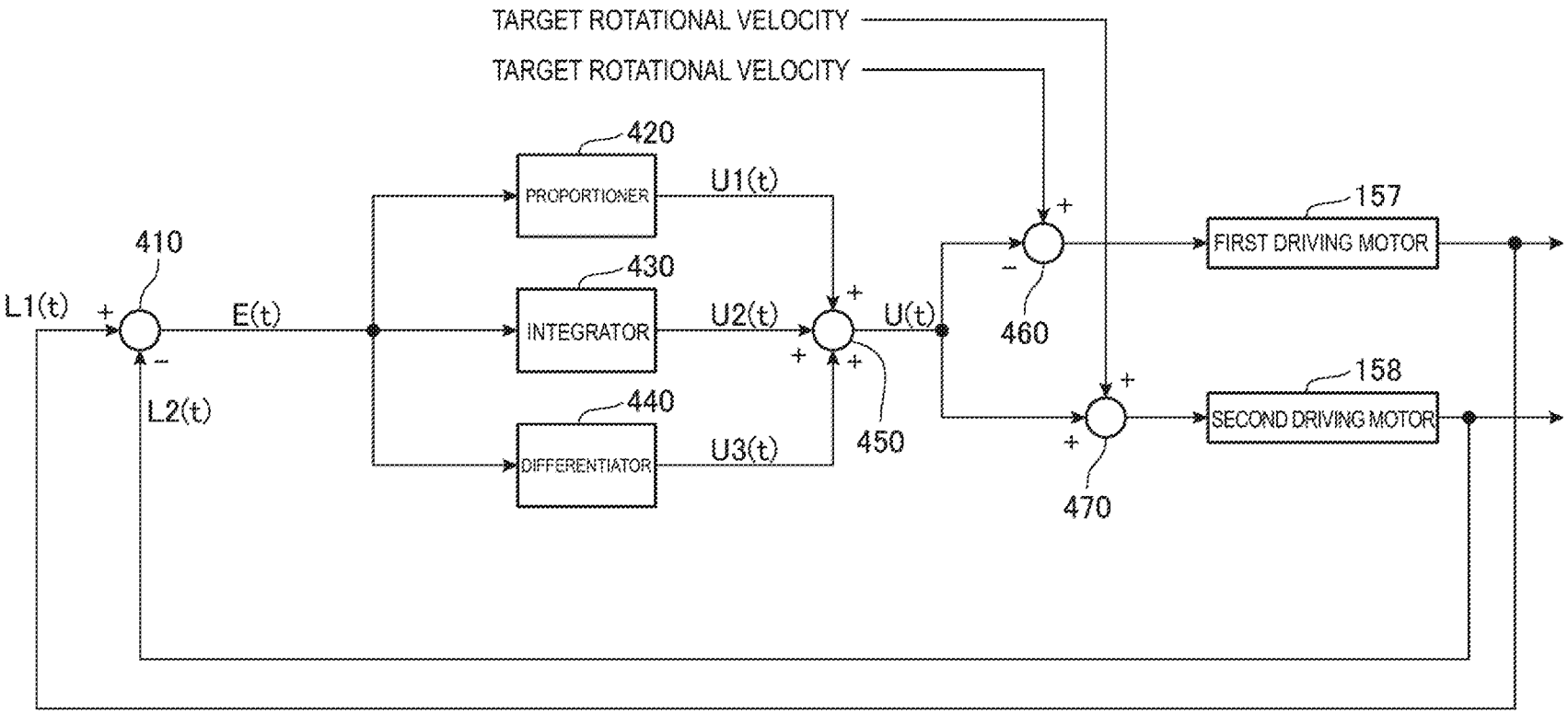
FIG. 7 is a view illustrating an example of a configuration of a feedback control unit.

FIG. 7 is a view illustrating an example of a configuration of the feedback control unit 3100.

As feedback control illustrated in FIG. 7, Proportional-Integral-Differential (PID) control is used.

The feedback control unit 3100 calculates rotational velocity of the first driving motor 157 and rotational velocity of the second driving motor 158 for every control cycle. Further, the feedback control unit 3100 updates the first driving motor 157 and rotational velocity of the second driving motor 158 for every control cycle. "t" in FIG. 7 indicates an executing timing of the control cycle.

The feedback control unit 3100 includes a first subtracter 410, a proportioner 420, an integrator 430, a differentiator 440, a first adder 450, a second subtracter 460, and a second adder 470.

The first subtracter 410 calculates a difference E (t) obtained by subtracting the load L2 (t), which is indicated with the second measured signal SG2 output from the second load cell 1442, from the load L1 (t), which is indicated with the first measured signal SG1 output from the first load cell 1441. Note that the first subtracter 410 has a target value of the difference E (t), which is zero, and hence the calculated difference E (t) corresponds to a deviation between the target value and the feedback value. The first subtracter 410 outputs the calculated difference E (t) to the proportioner 420, the integrator 430, and the differentiator 440.

The proportioner 420 calculates a proportional component U1 (t) from the input difference E (t), and outputs the calculated proportional component U1 (t) to the first adder 450. The integrator 430 calculates an integral component U2 (t) from the input difference E (t), and outputs the calculated integral component U2 (t) to the first adder 450. Further, the differentiator 440 calculates a differential component U3 (t) from the input difference E (t), and outputs the calculated differential component U3 (t) to the first adder 450.

The first adder 450 adds the values output from the proportioner 420, the integrator 430, and the differentiator 440, and outputs an addition value U (t) to the second subtracter 460 and the second adder 470. The addition value U (t) input to the second subtracter 460 and the second adder 470 has a unit indicating rotational velocity. The feedback control unit 3100 converts a physical unit of the load L measured by the load cells 144 into rotational velocity in a step before the second subtracter 460 and the second adder 470. With this, a physical unit of the addition value U (t) input to the second subtracter 460 and the second adder 470 indicates rotational velocity.

Rotational velocity, which corresponds to the transporting velocity indicated in the transporting velocity data 330C stored in the storage unit 330, is input to the second subtracter 460. In the following description, rotational velocity corresponding to the transporting velocity indicated in the transporting velocity data 330C is referred to as "target rotational velocity". The second subtracter 460 calculates rotational velocity obtained by subtracting the addition value U (t), which is output from the first adder 450, from the target rotational velocity. Further, the feedback control unit 3100 outputs the first instruction signal SG3, which indicates the rotational velocity calculated by the second subtracter 460, to the driving circuit 320. With this, the first driving motor 157 rotates at the rotational velocity calculated by the second subtracter 460.

The target rotational velocity is input to the second adder 470. The second adder 470 calculates rotational velocity obtained by adding the target rotational velocity to the addition value U (t) output from the first adder 450. Further, the feedback control unit 3100 outputs the second instruction signal SG4, which indicates the rotational velocity calculated by the second adder 470, to the driving circuit 320. With this, the second driving motor 158 rotates at the rotational velocity calculated by the second adder 470.

Note that the configuration of the feedback control unit 3100 illustrated in FIG. 7 is a configuration in which the first subtracter 410 calculates the difference E (t) obtained by subtracting the load L2, which is indicated with the second measured signal SG2 output from the second load cell 1442, from the load L1, which is indicated with the first measured signal SG1 output from the first load cell 1441. However, the feedback control unit 3100 may adopt a configuration in which the difference E (t) is calculated by subtracting the load L1, which is indicated with the first measured signal SG1 output from the first load cell 1441, from the load L2, which is indicated with the second measured signal SG2 output from the second load cell 1442. In this case, the rotational velocity calculated by the second subtracter 460 corresponds to rotational velocity of the second driving motor 158, and rotational velocity calculated by the second adder 470 corresponds to rotational velocity of the first driving motor 157.

Further, as the configuration of the feedback control unit 3100 illustrated in FIG. 7, a case of using the PID control is exemplified. However, a configuration of using proportional control may be adopted. In a case of the PID control, each of gains of proportional control, differential control, and integral control is adjusted. In a case of the proportional control, only one gain is adjusted, and hence feedback control can be performed easily.

Next, an operation of the control device 3 is described.

Figure 8:
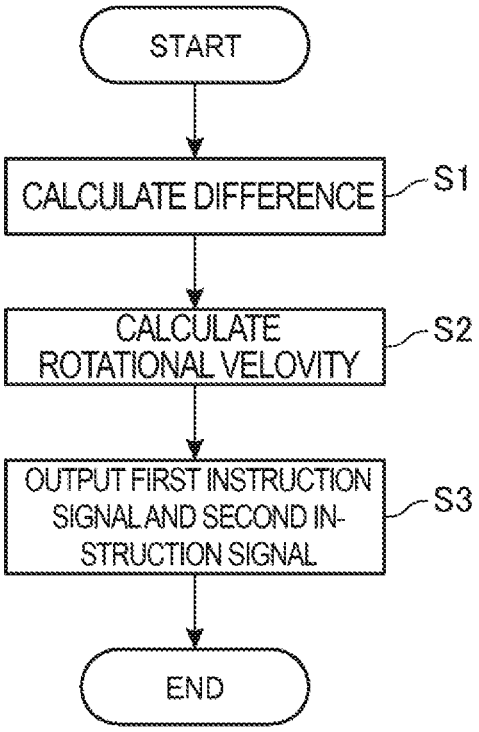
FIG. 8 is a flowchart illustrating an operation of a control device.

FIG. 8 is a flowchart illustrating an operation of the control device 3. Particularly, FIG. 8 illustrates an operation of the feedback control unit 3100.

The feedback control unit 3100 executes the operation in the flowchart illustrated in FIG. 8 every time the execution timing of the control cycle arrives.

The feedback control unit 3100 calculates the difference E (t) obtained by subtracting the load L2, which is indicated with the second measured signal SG2 output from the second load cell 1442, from the load L1, which is indicated with the first measured signal SG1 output from the first load cell 1441 (Step S1).

The feedback control unit 3100 calculates rotational velocity of each of the first driving motor 157 and the second driving motor 158, based on the difference E (t) calculated in Step S1 (Step S2).

Subsequently, the feedback control unit 3100 generates the first instruction signal SG3 and the second instruction signal SG4 based on the rotational velocity calculated in Step S2, and outputs the first instruction signal SG3 and the second instruction signal SG4, which are generated, to the driving circuit 320 (Step S3).

The following effects are exerted by the operation of the feedback control unit 3100.

For example, it is assumed that the right end of the printing medium 2 is transported in the transport direction precedently to the left end, that is, the printing medium 2 meanders rightward with respect to the transport direction as a reference. In this case, the transported amount of the right end of the printing medium 2 is larger than that of the left end, and hence a tensile force acting on the right end is larger than that on the left end. With this, at the winding roller portion 141, a force of the printing medium 2 pressing the second winding roller bearing 1413 downward is increased, and the load L2 detected by the second load cell 1442 is increased. Meanwhile, the left end has a transported amount smaller than that of the right end, and hence slackening is caused. With this, at the winding roller portion 141, a force of the printing medium 2 pressing the first winding roller bearing 1412 downward is reduced, and the load L2 detected by the first load cell 1441 is reduced. The feedback control unit 3100 performs feedback control. With this, the second driving motor 158 is caused to decelerate from the target rotational velocity, and the first driving motor 157 is caused to accelerate from the target rotational velocity. With this, the transported amount of the left end having a small transported amount can be increased while the transported amount of the right end having a large transported amount can be reduced. Thus, rightward meandering can be canceled. Further, during the feedback control, acceleration and deceleration are performed with the target rotational velocity as a reference, and hence the average transporting velocity of the printing medium 2 as a whole can be maintained to be transporting velocity corresponding to the target rotational velocity.

In this example, rightward meandering is given. Similarly, leftward meandering can be canceled by causing the transported amounts to be different from each other, and the average transporting velocity of the printing medium 2 as a whole can be maintained to be transporting velocity corresponding to the target rotational velocity.

As described above, the printing apparatus 1 includes the feeding shaft 211 that retains the printing medium 2 wound in a roll shape, the first transporting belt 151 that transports the printing medium 2 fed from the feeding shaft 211 in the transport direction, and the second transporting belt 152 that transports the printing medium 2 fed from the feeding shaft 211 in the transport direction, the second transporting belt 152 being arranged side by side with the first transporting belt 151 in the intersecting direction. Further, the printing apparatus 1 includes the first driving roller 153 and the first driven roller 155 on which the first transporting belt 151 is wound, the second driving roller 156 and the second driven roller 154 on which the second transporting belt 152 is wound, the first driving unit 110 that drives the first driving roller 153, and the second driving unit 120 that drives the second driving roller 156. Further, the printing apparatus 1 includes the winding roller 1411 provided upstream of the first transporting belt 151 and the second transporting belt 152 in the transport direction, the winding roller 1411 on which the printing medium 2 transported from the feeding shaft 211 to the first transporting belt 151 and the second transporting belt 152 is wound, the first winding roller bearing 1412 that supports the left end of the rotary shaft 1414 of the winding roller 1411, and the second winding roller bearing 1413 that supports the right end of the rotary shaft 1414 of the winding roller 1411. Further, the printing apparatus 1 includes the first load cell 1441 that detects the load L1 applied from the printing medium 2 to the first winding roller bearing 1412 through the winding roller 1411, and the second load cell 1442 that detects the load L2 applied from the printing medium 2 to the second winding roller bearing 1412 through the winding roller 1411. Further, the printing apparatus 1 includes the control unit 310 that controls the first driving unit 110 and the second driving unit 120 based on the detection results of the first load cell 1441 and the second load cell 1442.

With this configuration, based on a difference between the loads of the first winding roller bearing 1412 and the second winding roller bearing 1413, which are applied from the printing medium 2 due to meandering of the printing medium 2, driving control for the first transporting belt 151 and the second transporting belt 152 can be performed, and thus meandering of the printing medium 2 can be suppressed. Particularly, meandering can be suppressed without detecting the end of the printing medium 2, and hence meandering can be suppressed even for the deformable printing medium 2.

The one end of the first driving roller 153 in the axis direction is coupled to the first driving motor 157, and the other end is rotatably supported. The second driven roller 154 is assembled to the first driving roller 153, and is supported by the first driving roller 153 in a freely rotatable manner. The one end of the second driving roller 156 is coupled to the second driving motor 158, and the other end is rotatably supported. The first driven roller 155 is assembled to the second driving roller 156, and is supported by the second driving roller 156 in a freely rotatable manner.

With this configuration, the first driving roller 153 supports the second driven roller 154 in a freely rotatable manner, and the second driving roller 156 supports the first driven roller 155 in a freely rotatable manner. Thus, a member that supports the ends of the first driven roller 155 and the second driven roller 154 in the axis direction in a freely rotatable manner is not required to be arranged between the first transporting belt 151 and the second transporting belt 152 in the intersecting direction. Thus, the distance by which the first transporting belt 151 and the second transporting belt 152 are separated from each other can be reduced to be as small as possible, and the first transporting belt 151 and the second transporting belt 152 can be arranged side by side in the intersecting direction. Under a state in which the printing surface of the printing medium 2 is even, the first transporting belt 151 and the second transporting belt 152 can transport the printing medium 2. Thus, the printing apparatus 1 can improve printing quality.

The first load cell 1441 detects a tensile force acting on the left end of the printing medium 2 in the intersecting direction, as the load L1 applied to the first winding roller bearing 1412. The second load cell 1442 detects the right end of the printing medium 2 in the intersecting direction, as the load L2 applied to the second winding roller bearing 1413. The control unit 310 performs the PID control for the first driving unit 110 and the second driving unit 120 based on the detection results of the first load cell 1441 and the second load cell 1442 in such a way that a difference between the tensile forces acting on both the ends of the printing medium in the intersecting direction is reduced while maintaining transporting velocity of the printing medium 2 to be the predetermined velocity.

With this configuration, meandering of the printing medium 2 can be suppressed while maintaining transporting velocity of the printing medium 2 to be the predetermined velocity. Further, meandering is suppressed by the PID control, Thus, a constant deviation can be reduced, and meandering can be suppressed with satisfactory responsiveness. Thus, the printing apparatus 1 can quickly suppress meandering at high accuracy.

The control unit 310 performs the proportional control for the first driving unit 110 and the second driving unit 120 based on the detection results of the first load cell 1441 and the second load cell 1442 in such a way that a difference between the tensile forces exerted on both the ends of the printing medium 2 in the intersecting direction is reduced while maintaining transporting velocity to be the predetermined velocity.

With this configuration, only one gain is adjusted, and hence control for controlling meandering of the printing medium 2 can be performed easily while maintaining transporting velocity of the printing medium 2 to be the predetermined velocity.

The printing apparatus 1 includes the first auxiliary roller 142 and the second auxiliary roller 143 that support winding of the printing medium 2 about the winding roller 1411. The first auxiliary roller 142 is arranged upstream of the winding roller 1411 in the transport direction. The second auxiliary roller 143 is arranged downstream of the winding roller 1411 in the transport direction.

With this configuration, the printing medium 2 can be wound about the winding roller 1411 in such a way that the printing medium 2 can applied the load L to the winding roller 1411. Thus, the first load cell 1441 and the second load cell 1442 can securely measure the load L applied from the printing medium 2 to the first winding roller bearing 1412 and the second winding roller bearing 1413.

Second Exemplary Embodiment

Next, a second exemplary embodiment is described.

As compared to the first exemplary embodiment, the printing apparatus 1 according to the second exemplary embodiment is different in a configuration of the transporting belt unit 15.

Figure 9:
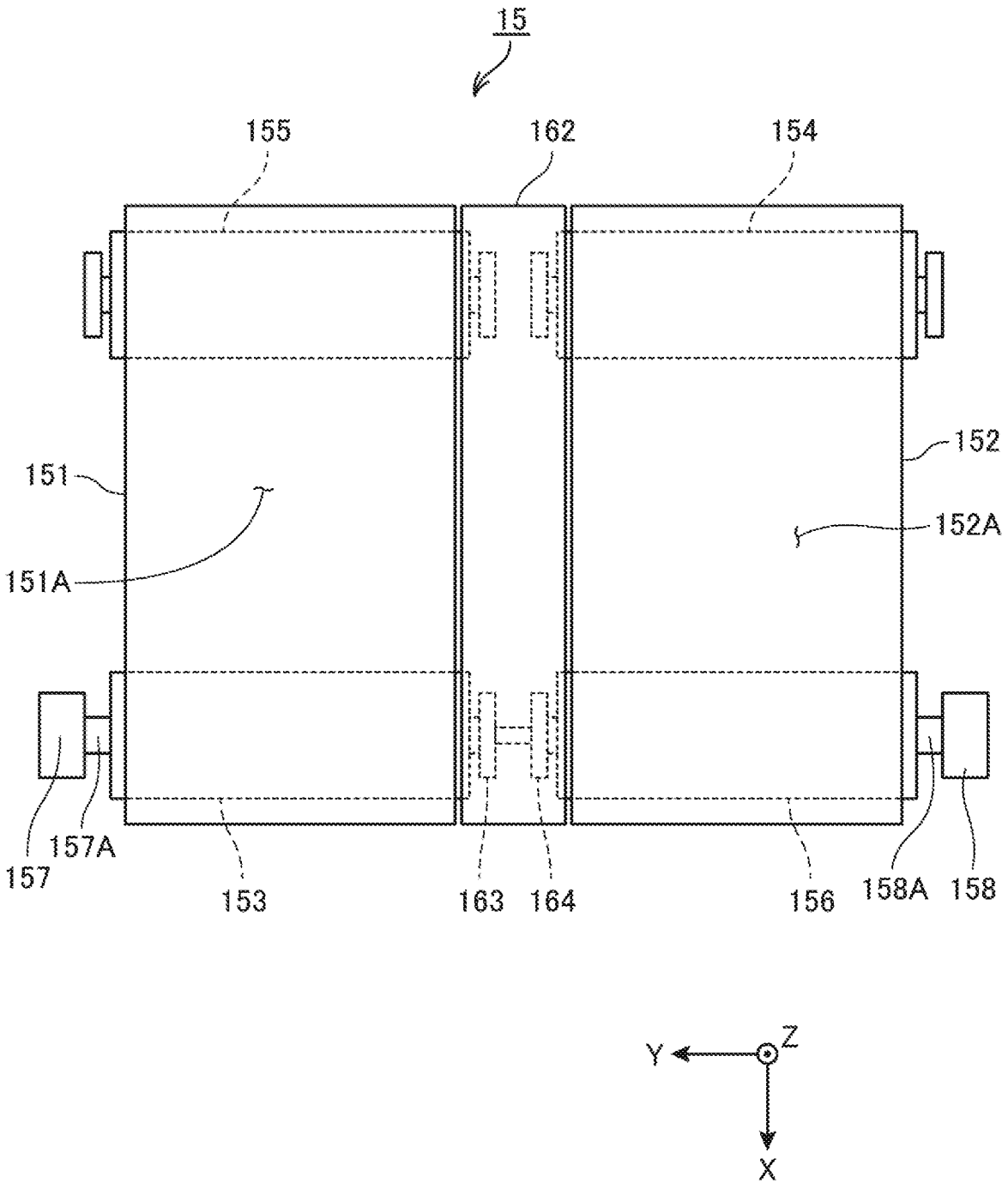
FIG. 9 is a plan view of a transporting belt unit according to a second exemplary embodiment seen from above.
Figure 10:
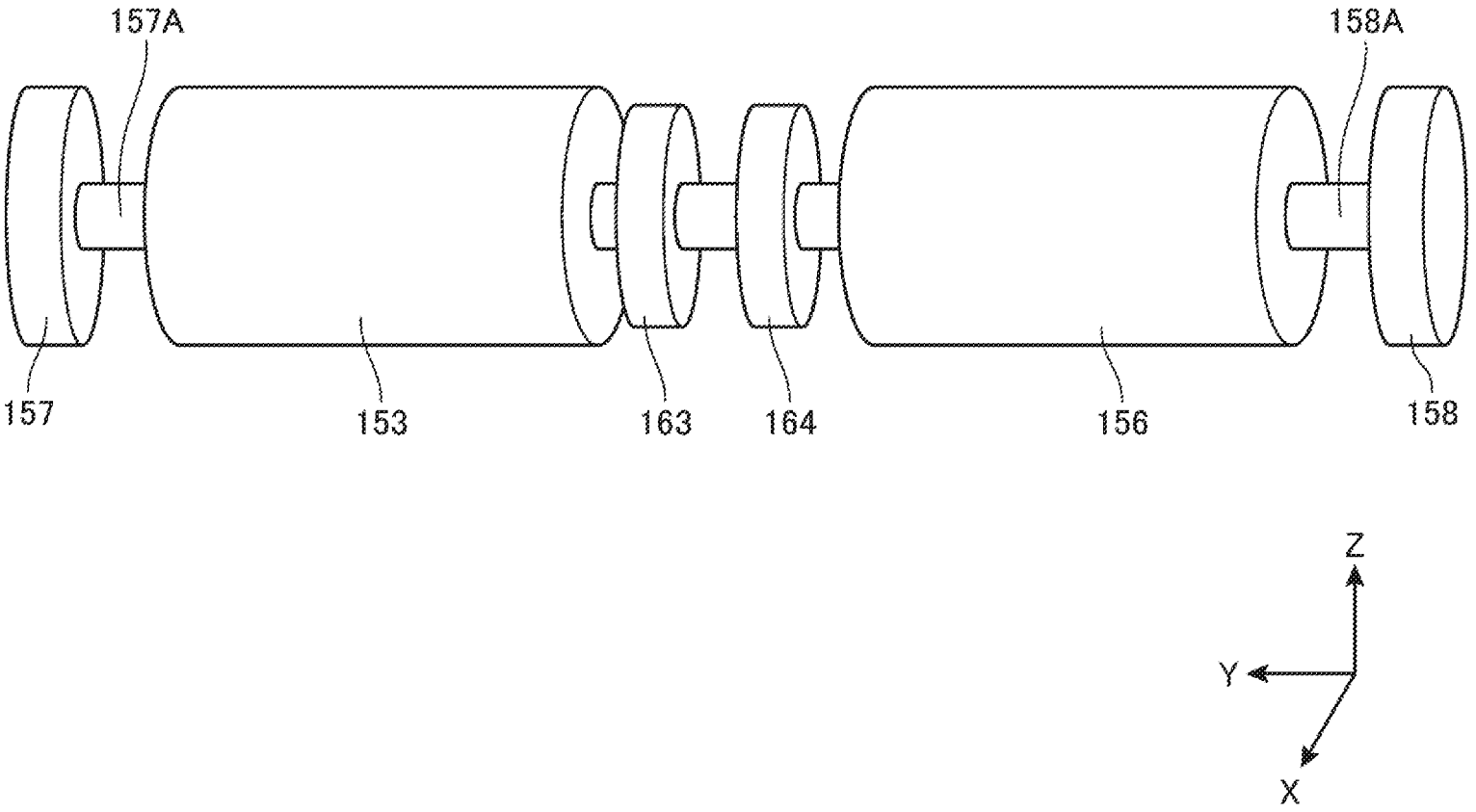
FIG. 10 is a perspective view of a first driving roller and a second driving roller according to the second exemplary embodiment.

FIG. 9 is a plan view of the transporting belt unit 15 according to the second exemplary embodiment seen from above. FIG. 10 is a perspective view of the first driving roller 153 and the second driving roller 156 according to the second exemplary embodiment.

The transporting belt unit 15 according to the second exemplary embodiment includes the first transporting belt 151, the second transporting belt 152, the first driving roller 153, the second driving roller 156, the first driven roller 155, the second driven roller 154, and a plate member 162.

As illustrated in FIG. 9 and FIG. 10, the first driving roller 153 and the second driving roller 156 are columnar or tubular rollers, and are configured in such a way that the outer diameters are not different from each other in the axis direction as compared to the first driving roller 153 and the second driving roller 156 according to the first exemplary embodiment.

The first transporting belt 151 is wound about the first driving roller 153 and the first driven roller 155. The second transporting belt 152 is wound about the second driving roller 156 and the second driven roller 154.

The first driving roller 153 is coupled to the first driving motor 157, and rotates with a driving force of the first driving motor 157. The first driven roller 155 is arranged side by side with the first driving roller 153 in the transport direction. The left end of the first driving roller 153 in the axis direction is coupled to the first driving motor 157 through the driving shaft 157A. Further, the right end of the first driving roller 153 in the axis direction is rotatably supported by a bearing 163.

The second driving roller 156 is arranged side by side with the first driving roller 153 in the intersecting direction, is coupled to the second driving motor 158, and rotates with a driving force of the second driving motor 158. The second driven roller 154 is arranged side by side with the second driving roller 156 in the transport direction. The right end of the second driving roller 156 in the axis direction is coupled to the second driving motor 158 through the driving shaft 157A. Further, the left end of the second driving roller 156 in the axis direction is rotatably supported by a bearing 164.

The plate member 162 is arranged in the intersecting direction with the first transporting belt 151 and the second transporting belt 152 in such a way that a surface 162A of the plate member, the surface 151A of the first transporting belt 151, and the surface 152A of the second transporting belt 152 are flush with one another. With this, under a state in which the printing surface of the printing medium 2 is even, the first transporting belt 151 and the second transporting belt 152 can transport the printing medium 2 in the printing apparatus 1.

As described above, in the second exemplary embodiment, the first driving roller 153 and the second driving roller 156 are arranged side by side in the intersecting direction. The one end of the first driving roller 153 in the axis direction is coupled to the first driving motor 157, and the other end is rotatably supported. The one end of the second driving roller 156 is coupled to the second driving motor 158, and the other end is rotatably supported.

In the first exemplary embodiment, the first driving roller 153 and the second driving roller 156 are not arranged side by side in the intersecting direction. Thus, in the first exemplary embodiment, the part of the first transporting belt 151, which supports or retains the printing medium 2, corresponds to the part wound about the first driving roller 153, and the part of the second transporting belt 152, which supports or retains the printing medium 2, is the part fed from the second driving roller 156. In the second exemplary embodiment, the parts of the first transporting belt 151 and the second transporting belt 152, which support or hold the printing medium 2, can be aligned as the parts wound about the rollers that drive the belt. Thus, tensile forces of the parts of the first transporting belt 151 and the second transporting belt 152, which support or hold the printing medium 2, can be equalized more securely than those in the first exemplary embodiment. Thus, the printing medium 2 can be transported with the even printing surface. Thus, in the second exemplary embodiment, even with the deformable printing medium 2, meandering can be suppressed, and printing quality can be improved.

Each of the exemplary embodiments described above is merely a specific example to which the present disclosure is applied. The present disclosure is not limited to the configurations in the exemplary embodiments described above, and can be implemented in various aspects without departing from the gist of the disclosure.

For example, the configuration in which the first transporting belt 151 and the second transporting belt 152 include the adhesive layers adhering to the printing medium 2 is described. However, the present disclosure is not limited thereto. An electrostatic attraction belt that electrostatically attracts the printing medium 2 to the first transporting belt 151 and the second transporting belt 152 may be adopted.

Further, in each of the exemplary embodiments described above, the configuration in which the meandering detection unit 14 is arranged on the upper side with respect to the transporting belt unit 15 is exemplified. However, the meandering detection unit 14 may be arranged on the lower side with respect to the first transporting belt 151 and the second transporting belt 152 of the transporting belt unit 15, and may be arranged upstream in the transport direction. In this case, the winding roller portion 141 is arranged on the lower side with respect to the first auxiliary roller 142 and the second auxiliary roller 143. Further, in this case, the first load cell 1441 is arranged to abut on the upper part pf the first winding roller bearing 1412, and detects a force of the printing medium 2 pushing the winding roller 1411 upward as the load L1. Further, in this case, the second load cell 1442 is arranged to abut on the upper part of the second winding roller bearing 1413, and detects a force of the printing medium 2 pushing the winding roller 1411 upward as the load L2.

Further, in each of the exemplary embodiments described above, as the ejection head 31, a serial head type ejection head, which is mounted to the movable carriage 32 and ejects ink while moving in the ±Y-axis direction, is exemplified. However, a line head type ejection head, which extends and is fixed to be arranged in the Y-axis direction including the width of the printing medium 2, may be adopted.

Further, in the printing apparatus 1, the number and arrangement of rollers and motors in the mechanism of transporting the first transporting belt 151 and the second transporting belt 152, which are in an endless shape, are freely selected, and can be changed as appropriate in accordance with sizes of the first transporting belt 151 and the second transporting belt 152, and the printing medium 2.

At least some of the function blocks illustrated in FIG. 6 may be achieved with hardware, or achieved in collaboration with hardware and software. A processing unit in the flowchart in FIG. 8 is obtained by dividing processing in accordance with a main processing content to facilitate the understanding of the processing of the control device 3. Thus, the exemplary embodiments are not limited by the illustrated method or name for dividing the processing into the processing units.

What is claimed is:

1. A printing apparatus, comprising:

a feeding shaft configured to hold a printing medium wound in a roll shape;

a first transporting belt configured to transport, in a transport direction, the printing medium fed from the feeding shaft;

a second transporting belt configured to transport, in the transport direction, the printing medium fed from the feeding shaft, the second transporting belt being arranged side by side with the first transporting belt in an intersecting direction intersecting the transport direction;

a first driving roller and a first driven roller on which the first transporting belt is wound;

a second driving roller and a second driven roller on which the second transporting belt is wound;

a first driving unit configured to drive the first driving roller;

a second driving unit configured to drive the second driving roller;

a winding roller on which the printing medium is wound that is transported from the feeding shaft to the first transporting belt and the second transporting belt;

a first bearing configured to support one end of a shaft of the winding roller;

a second bearing configured to support another end of the shaft of the winding roller;

a first detector configured to detect a load exerted by the printing medium on the first bearing through the winding roller;

a second detector configured to detect a load exerted by the printing medium on the second bearing through the winding roller; and a control unit configured to control the first driving unit and the second driving unit based on detection results of the first detector and the second detector.

2. The printing apparatus according to claim 1, wherein the first driving unit includes a first driving motor configured to drive the first driving roller, one end in an axis direction of the first driving roller is coupled to the first driving motor, and another end is rotatably supported, the second driven roller is assembled to the first driving roller, and is rotatably supported by the first driving roller, the second driving unit includes a second driving motor configured to drive the second driving roller, one end in an axis direction of the second driving roller is coupled to the second driving motor, and another end is rotatably supported, and the first driven roller is assembled to the second driving roller, and is rotatably supported by the second driving roller.

3. The printing apparatus according to claim 1, wherein the first driving unit includes a first driving motor configured to drive the first driving roller, the second driving unit includes a second driving motor configured to drive the second driving roller, the first driving roller and the second driving roller are arranged side by side in the intersecting direction, one end in an axis direction of the first driving roller is coupled to the first driving motor, and another end is rotatably supported, and one end in the axis direction of the second driving roller is coupled to the second driving motor, and another end is rotatably supported.

4. The printing apparatus according to claim 1, wherein the first detector is configured to detect a tensile force as a load exerted on the first bearing, the tensile force acting on one end of the printing medium in the intersecting direction, the second detector is configured to detect a tensile fore as a load exerted on the second bearing, the tensile force acting on another end of the printing medium in the intersecting direction, the control unit is configured to perform PID control of the first driving unit and the second driving unit based on detection results of the first detector and the second detector in such a way to reduce a difference between the tensile forces acting on both ends in the intersecting direction of the printing medium while maintaining a transporting velocity of the printing medium at a predetermined velocity.

5. The printing apparatus according to claim 4, wherein the control unit is configured to perform proportional control of the first driving unit and the second driving unit based on detection results of the first detector and the second detector in such a way to reduce a difference between the tensile forces exerted on both ends in the intersecting direction of the printing medium while maintaining transporting velocity at a predetermined velocity.

6. The printing apparatus according to claim 1, comprising:

a first auxiliary roller and a second auxiliary roller configured to support winding of the printing medium on the winding roller, wherein the first auxiliary roller is arranged upstream of the winding roller in the transport direction, and the second auxiliary roller is arranged downstream of the winding roller in the transport direction.

7. The printing apparatus according to claim 1, wherein the first detector and the second detector are load cells.

* * * * *